US007048832B2

(12) United States Patent
Lemmons et al.

(10) Patent No.: US 7,048,832 B2
(45) Date of Patent: May 23, 2006

(54) METHOD AND SYSTEM FOR EXTRACTING HYDROCARBON FUEL PRODUCTS FROM PLASTIC MATERIAL

(75) Inventors: Donald W. Lemmons, Kelso, WA (US); Richard William Sheu, Rainier, OR (US)

(73) Assignee: Material Conversion Corp., Kelso, WA (US)

( * ) Notice: Subject to any disclaimer, the term of this patent is extended or adjusted under 35 U.S.C. 154(b) by 382 days.

(21) Appl. No.: 10/153,032

(22) Filed: May 21, 2002

(65) Prior Publication Data

US 2003/0130548 A1 Jul. 10, 2003

Related U.S. Application Data

(63) Continuation-in-part of application No. 10/041,108, filed on Jan. 7, 2002, now abandoned.

(51) Int. Cl.
*B01D 3/00* (2006.01)

(52) U.S. Cl. ..... 202/81; 202/84; 202/85; 202/105; 202/118

(58) Field of Classification Search ..... 202/81, 202/84, 85, 105, 118
See application file for complete search history.

(56) References Cited

U.S. PATENT DOCUMENTS 4,235,676 A 11/1980 Chambers
4,412,889 A * 11/1983 Oeck ..... 202/117
4,642,401 A 2/1987 Coenen et al.
4,686,008 A 8/1987 Gibson
5,756,871 A 5/1998 Wang
5,811,606 A 9/1998 Yang
5,824,193 A 10/1998 Edwards ..... 201/7
5,856,599 A 1/1999 Kuroki
5,969,201 A 10/1999 Kalnes et al.
5,973,217 A 10/1999 Hastrich et al.
5,998,682 A 12/1999 Chien
6,011,187 A 1/2000 Horizoe et al.
6,060,631 A 5/2000 James, Jr. et al.
6,133,491 A 10/2000 Xing
6,150,577 A 11/2000 Miller et al.
6,172,271 B1 1/2001 Horizoe et al.
6,172,275 B1 1/2001 Tadauchi et al.
6,184,427 B1 2/2001 Klepfer et al.
6,251,148 B1 6/2001 Redepenning et al.
6,270,630 B1 8/2001 Xing

* cited by examiner

*Primary Examiner*—Glenn Caldarola
*Assistant Examiner*—Alexis Wachtel
(74) *Attorney, Agent, or Firm*—Renner, Otto, Boisselle & Sklar, LLP

(57) ABSTRACT

A method and system for extracting hydrocarbon fuel products from plastic material provides extraction of usable fuel components from waste plastic materials. The materials (or hydrocarbon portion thereof) are liquified and introduced to a chamber where the liquid material is agitated and a negative relative pressure (vacuum) is applied. The liquid is maintained at a substantially constant temperature and the vacuum draws the off-gas hydrocarbon products out for condensation and further processing, while unconverted char is removed to an ash dump. An auger feed unit with agitator buckets is used to propel the char through a feed while agitating the liquid to enhance the rate of gas removal.

28 Claims, 6 Drawing Sheets

METHOD AND SYSTEM FOR EXTRACTING HYDROCARBON FUEL PRODUCTS FROM PLASTIC MATERIAL

CROSS-REFERENCE TO RELATED APPLICATION

The present application is a continuation-in-part of U.S. patent application Ser. No. 10/041,108 filed on Jan. 7, 2002 ABN, the specification of which is herein incorporated by reference.

BACKGROUND OF THE INVENTION

1. Field of the Invention

The present invention relates generally to recyclable materials recovery systems, and more specifically, to a method and system for extracting useable hydrocarbon fuel products from waste material by conversion of fuel pre-products to gas.

2. Background of the Invention

A significant amount of waste material produced by residential and commercial facilities comprises plastics. Unless a recovery and/or recycling system is implemented, these plastics ultimately end up in landfills or are incinerated, producing undesirable gaseous pollutant products and ash. Some plastics may be recycled and used in part to form new plastic products, but it is possible to revert plastics to constituent chemical components or other compounds and re-use these compounds to produce fuel or for other manufacturing purposes.

Other waste materials, such as oilfield sludge (a mixture of tar, sand and dirt), absorbent materials that have been used to clean up oil spills and byproducts of other manufacturing and refining processes may contain useable hydrocarbon fuel components, also. It would be desirable to be able to process these materials in a similar manner as the method used to convert plastic waste material.

In particular, it is possible to produce a diesel-like fuel from hydrocarbon compounds that may be extracted from plastics and other waste. At high temperatures, the compounds are a gaseous mixture containing various hydrocarbons, aromatics and other gases. The gases may then be further separated and processed by distillation or other refining means to produce various usable fractions. In general, the resulting liquid condensed from the extracted gases cannot be burned in a diesel engine, as the spectrum of hydrocarbons produced from a mixture of plastics, or a solitary plastics contains a high fraction of "hot" components such as octane that will destroy a diesel engine unless the fraction is reduced to tolerable levels via a refining process. In general, all of the product should be useable, as octane can be used to make a gasoline fuel and lighter components may be "cracked" to form propane and synthetic natural gas fuels.

Several existing methods and systems have been proposed to revert plastic materials to gas from which fuel may be produced. In general, these systems fall into two categories: low temperature vapor extraction methods and high temperature pyrolytic conversion methods. The pyrolytic conversion methods require high energy input and generate gaseous fuel products such as butane and methane which require compression and large volume storage per BTU. The efficiency of conversion is very low, as the long-chain hydrocarbons present in plastics are converted to very short-chain hydrocarbon fuel components, wasting the energy available in the longer chains already present in plastics and other waste material.

Vapor extraction methods in the existing art have a low production throughput and are prone to a build-up of cross-linked polymers that must be removed from the equipment and a build-up of heavy hydrocarbon components that are not effectively removed from the system. They also are susceptible to environmental conditions such as barometric pressure and ambient temperature. These drawbacks have made existing vapor extraction systems not practical for both economic and production volume reasons.

Therefore, it is desirable to provide a method and system for extracting usable hydrocarbon fuel products from waste material in an energy efficient manner having high production throughput.

SUMMARY OF THE INVENTION

The above objective of providing efficient and high-throughput extraction of useable hydrocarbon fuel components from plastic material is achieved in a method and system. The method and system introduce waste material to a melting chamber having a substantially constant temperature and a liquid fuel pre-product is generated. The liquid is introduced to a process chamber at a substantially constant higher temperature and a negative relative pressure (vacuum) is applied to cause the liquid to off-gas the useable hydrocarbon fuel components in gaseous form. The liquid is agitated as well as heated to promote off-gassing. The melting chamber and process chamber may be a staged feed system having two different portions and an auger may be used to feed the waste material through the chambers. The remainder of the waste material is ejected at the far end of the process chamber and may be combined with the output of other chambers and re-processed for further extraction of useable fuel components.

The foregoing and other objectives, features, and advantages of the invention will be apparent from the following, more particular, description of the preferred embodiment of the invention, as illustrated in the accompanying drawings.

DETAILED DESCRIPTION OF THE EMBODIMENTS

Figure 1:
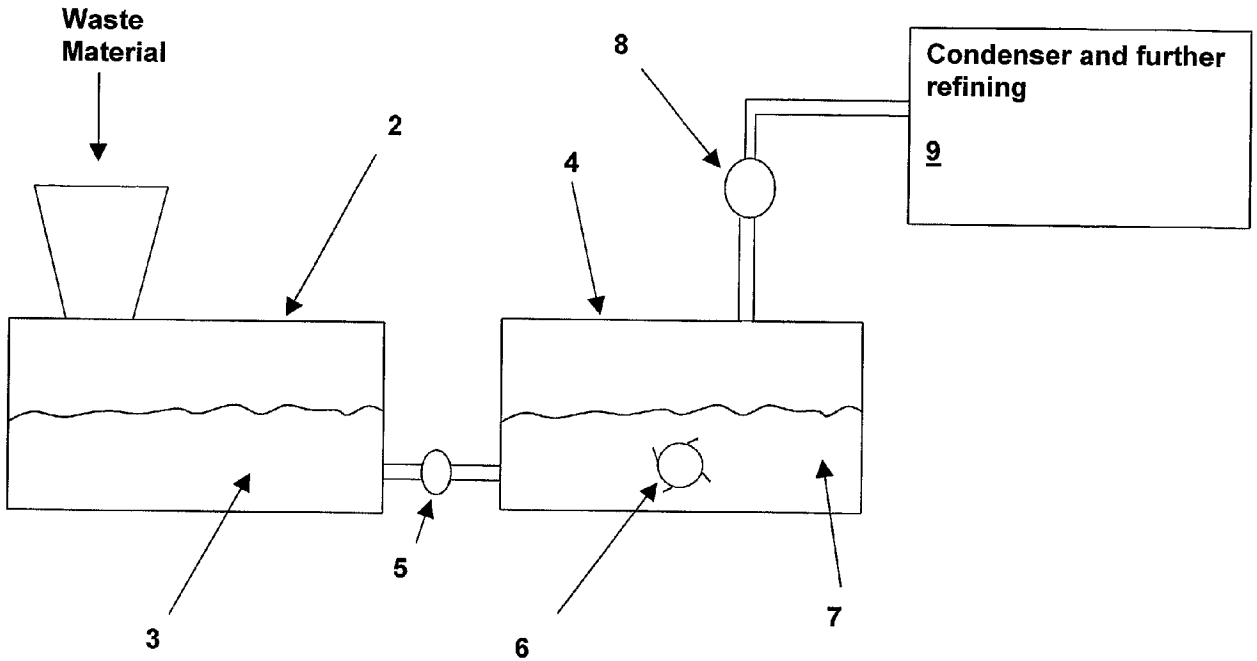
FIG. 1 is a simplified pictorial diagram depicting a system in accordance with an embodiment of the present invention.

Referring now to the figures and in particular to FIG. 1, a simplified depiction of a system for extracting hydrocarbon fuel products from waste material in accordance with an embodiment of the present invention is shown. Waste material is introduced to a hopper 1 and is liquified in a liquification chamber 2. Liquification chamber 2 can accept contaminated soil or plastic material, which is generally shredded and compressed. The hydrocarbon components in the waste material are melted to form a liquid 3 by heating liquification chamber 2 to a temperature substantially equal to 585 degrees Fahrenheit. The above-stated temperature is chosen as a minimum temperature in a plastics processing system to reduce a plastic mixture containing typical recyclable plastics to a liquid and a maximum temperature to avoid forming a cross-linked solid.

Cross-linked polymers generally have a higher melting point than recyclable plastic waste and will not readily convert to hydrocarbon fuel components via the system once they have been produced by over-temperature. Therefore, the temperature of liquification chamber 2 should be carefully controlled so that no solid plastics remain and so that none of the plastic material becomes cross-linked.

Liquification chamber 2 is included to ensure that solid plastic material is not introduced to further processing, which will be performed at a higher temperature. The higher temperature processing will form cross-linked chains within any solid plastic material. Processing liquified plastics provides a mechanism for avoiding the overheating of solid plastics and thus the cross-linking of the plastics' hydrocarbon chains.

A pump 5 moves the liquified plastics 3 to a process chamber 4, where the liquified plastics (which contain hydrocarbon fuel pre-products) are further heated to a temperature between 850 and 890 degrees Fahrenheit (and preferably substantially equal to 850 degrees Fahrenheit) and are permitted to off-gas. The above-stated temperature is a maximum temperature chosen to cause the liquified plastic to off-gas rapidly, while avoiding "cracking" of the hydrocarbon fuel products such as decane to shorter-chain hydrocarbon components, as is done in pyrolytic converters. The higher temperature of process chamber 4 is generally above the flash point of the gaseous fuel components that are being extracted, and therefore the system must substantially prevent the introduction of air within process chamber 4 (and possibly liquification chamber 2). Otherwise the fuel products may combust in the chamber, creating a hazard and wasting the fuel components extracted.

Some off-gassing will also occur in liquification chamber 2 and these gases may be removed by a vent 8A, but primarily, the gases (which contain hydrocarbon fuel products) will be extracted via a vacuum pump 8. Vacuum pump 8 is included to remove the gases produced by the off-gassing liquid plastic material 7. Without vacuum pump 8, insufficient gas will exit the system, and the heavier vapor components (such as paraffin) will remain in the system. Additionally, the effects of ambient barometric pressure and temperature on the system are eliminated. A system without negative relative pressure applied to the process chamber will not remove heavier gaseous hydrocarbon fuel components when the outside temperature falls too low. As a result, continued "cracking" of the hydrocarbon fuel products occurs and under certain ambient conditions, the output will be only lighter components that cannot condense to form a liquid fuel. Additionally, the overall output of a non-vacuum driven system under the above-described conditions will be reduced to a small fraction of the potential system production.

Once the gases are removed, they are introduced to a processing system 9 for condensation of heavier fuel components, further refining of heaviest fuel components and potential extraction and storage of lighter fuel components. But, the lighter fuel components are useful for combustion heating of process chamber 4 and liquification chamber 2 and will generally be used for this purpose.

The present invention may also be adapted (or used in an existing form) for the processing of other material containing usable hydrocarbon fuel pre-products. Drill cuttings or other waste from oil drilling sites (which is a mixture of sand or dirt and crude oil) may be heated to extract the contained hydrocarbon fuel pre-products and off-gas fuel components. Additionally, tank bottom material from crude oil storage or other hydrocarbon-containing storage may be processed, which may also contain some level of contaminant such as soil or may be mixed with contaminated soil. Also, in soil remediation activities, the methods and apparatus of the present invention may be used to dispose of the hydrocarbon content of contaminated soils, rather than attempting to produce a fuel product. Optionally, liquification chamber may not be required for the above-mentioned types of processing (if the waste material does not contain polymers that will become cross-linked) and systems may be specially adapted in accordance with embodiments of the present invention.

Figure 2:
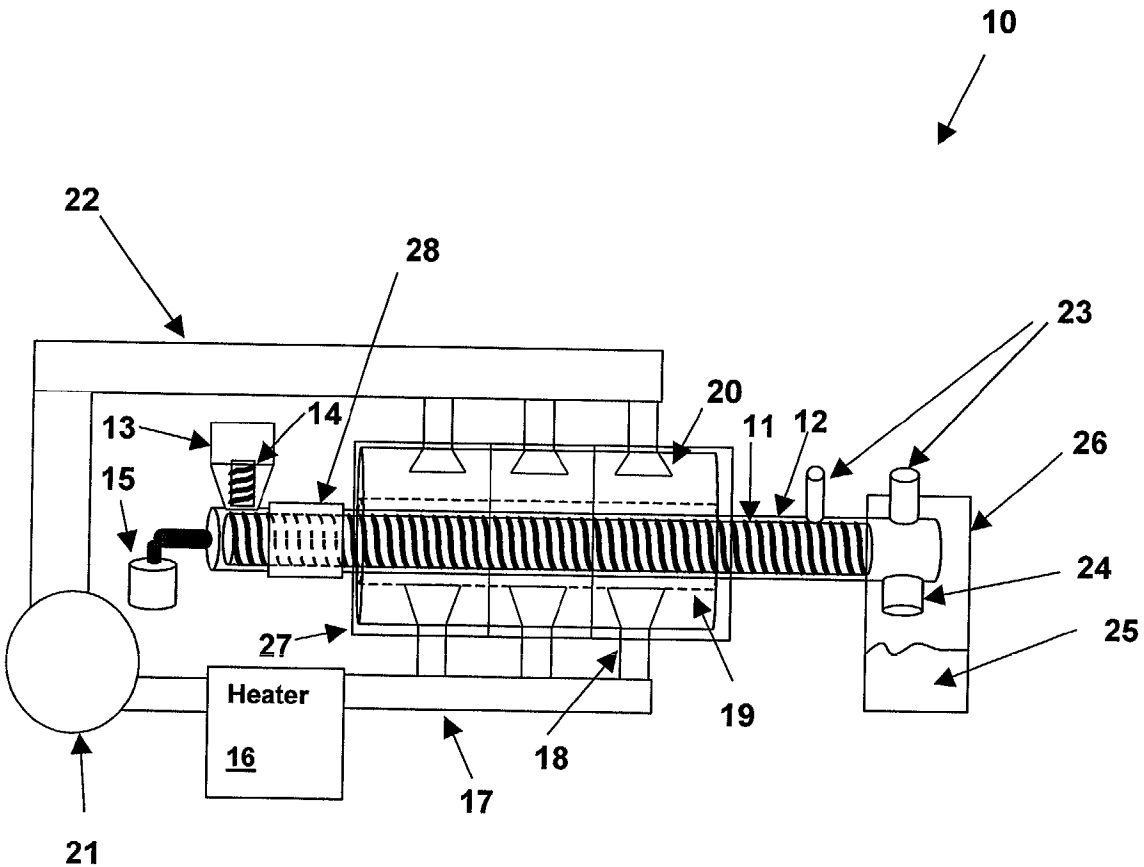
FIG. 2 is a detailed pictorial diagram depicting a system in accordance with an embodiment of the present invention.

Referring now to FIG. 2, a plastic reversion system 10, in accordance with an embodiment of the present invention is shown. A process chamber 12 is formed from a cylindrical pipe with an auger 11 disposed within and passes through within a heating unit 27. A separate liquification chamber is not implemented within system 10 but is provided by heating a first portion of auger 11 and process chamber 12 (before entering heating unit 27) to a lower temperature at least 585 degrees Fahrenheit (and preferably substantially equal to 585 degrees Fahrenheit) for the first section of the process chamber 12 via electric heat sheath 28. Auger 11 is rotated by a drive system 15 at a substantially constant rate. Plastic material chips are introduced to process chamber 12 from a feed hopper 13 and a feed auger 14 may be used to compress the plastic material for introduction to process chamber 12 under pressure, eliminating introduction of air. Auger 11 drives the plastic material through process chamber 12 at a substantially constant rate. Both auger 11 and feed auger 14 may be driven by an electric motor and gearbox combination, a hydraulic motor or pneumatic motor depending on requirements of the particular system application. Process chamber 12 is generally a metal pipe, and the diameter of auger 11 and process chamber 12 are determined by throughput requirements. The length of auger 11 and angle of the auger flights are chosen to determine the "dwell time" (the time the plastic material take to travel through process chamber 12), which is a critical factor in reverting the plastic material to gas.

Process chamber 12 is heated by a heating system comprising a heater 16 for heating air, ducting 17 for delivering the heated air to ports 18 within heating unit 27 that are coupled directly to a pressure chamber 19 that encloses a portion of process chamber 12. Electric heat sheath 28 may be replaced by a heating system porting air from heater 16 or a second heater, so that the lower liquification temperature may be maintained over the first segment of process chamber 12 that acts as a liquification chamber. Air exits heating unit 27 through ports 20 and is recirculated via a duct 22 and blower 21, returning to heater 16. The heating system produces a high pressure air stream around process chamber 12. The air is heated to raise the temperature of the portion of auger 11 and process chamber 12 within heating unit 27 to approximately 850 degrees Fahrenheit.

The plastic material undergoes phase changes as it is driven around the heated auger 11, and near the end of auger 11 exit pipes 23 are connected to remove the gaseous mixture produced within process chamber 12 and at the end of auger opposite feed hopper 13. The gas mixture removed at exit pipe 23 is a mixture of many different compounds and gaseous elements and may be condensed, refined or otherwise processed to yield useful products. In general, a very clean-burning fuel product may be refined from the gaseous mixture. Yield output is approximately one gallon of distillate from eight to nine pounds of plastic material. Waste material 25 from the process, called "char" or ash is dropped from a lower exit pipe 24 to a char pit 26 for disposal.

A vacuum system 29 applies a negative relative pressure to process chamber 12, assisted by an "air dam" that is created by compressed plastic material at a point along auger 11 before the plastic material has reached a completely liquid state. Vacuum system 29 generates a suction that draws against the air dam, generating a negative relative pressure throughout process chamber 12, which aids in the conversion of the plastic material from liquid to gas and increases the yield of the system to a practical production level. The vacuum level generated within process chamber 12 is approximately −0.07 psig at steady-state operation. In contrast to prior-art pyrolytic conversion systems that pressurize the process chamber in order to produce a particular composition of heavy-hydrocarbon gases, the present invention uses a negative relative pressure to promote off-gassing from the liquified plastic material.

Figure 3:
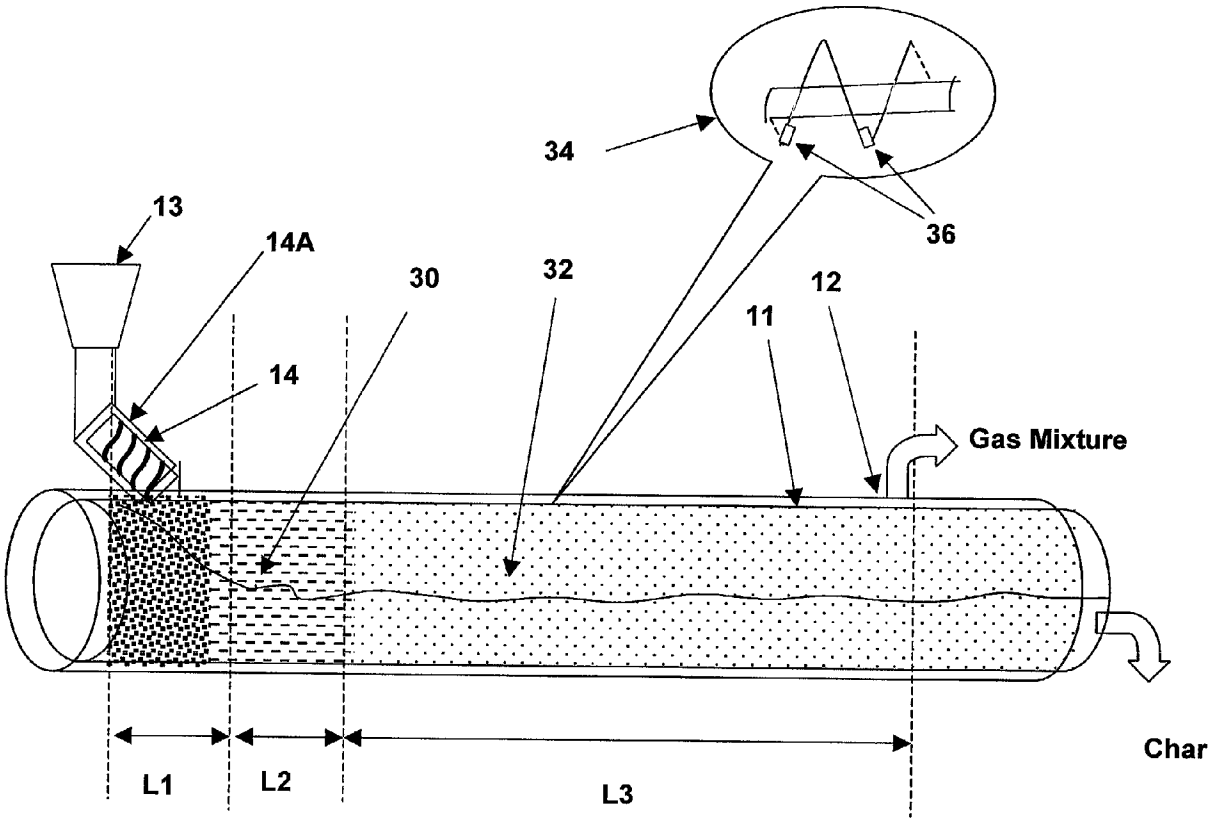
FIG. 3 is a pictorial diagram depicting details of the processing of waste material within process chamber 12 of FIG. 2.

Referring now to FIG. 3, the processing of waste material within the system of FIG. 2 is depicted with reference to a detailed representation of process chamber 12. Feed auger 14 compresses plastic chips from feed hopper 13 and introduces them to auger 11 within process chamber 12. Feed auger 14 is inclined with respect to auger 11 to avoid jamming that may occur with a perpendicular feed. Feed auger 14 includes a water jacket 14A that cools the feed inlet stage to prevent jamming and liquification of plastic material prior to entering process chamber 12. The rotation of auger 11 moves the waste material, which contains hydrocarbon fuel pre-products still in solid form, and heat is transferred from heat sheath 28 to auger 11 and process chamber 12 to melt the hydrocarbons contained in the waste material. Auger 11 may be coated with a low-friction or non-stick material to prevent build-up of waste material or hydrocarbon pre-products on the blades. Prevention of build-up enhances efficiency of the processing system, since any accumulation on auger 11 blades will cause a significant reduction in the surface area of the plastic material that is exposed over time, reducing the off-gassing of the liquified plastic material.

Auger 11 further includes small buckets 36 (in callout 34) attached to the outside edges of the auger blade over a portion of the length of auger 11 to agitate the liquified hydrocarbon material, generally within the first portion of length L2. Agitating the liquified hydrocarbon material exposes more of the surface area, promotes heating of the entire liquid mass and permits bubbles of gaseous hydrocarbon fuel products to escape, enhancing the efficiency of the system.

At the end of length L1, the plastic or hydrocarbon within the waste material has become liquified and pools on the bottom of process chamber. It is near the beginning of length L1 that the approximate location of air dam lies (where solid material is compacted prior to complete liquification and in the case of soil processing where the soil is compacted as it does not liquify), and a negative relative pressure will be exerted on the waste material ahead of this location. In length L2, the hydrocarbons in the waste material become completely liquified and within length L3, the hydrocarbons are converted to gaseous form with some solid waste product remaining (char). At the end of process chamber 12, the char are ejected for disposal or further processing. The gases are removed for processing by vents located within length L3 and coupled to a vacuum system that generates the negative relative pressure (vacuum) within process chamber 12.

While the above description and illustrations depict a process having generally defined phase boundaries and temperatures and the description suggests uniform composition, in practice, the waste material introduced to feed hopper 13 may comprise many different plastic materials or soils containing varied hydrocarbon content, and the mixture may vary substantially over time. Therefore, different temperatures may be used and the material within process chamber 12 may transition to liquid form at varying locations. But, it has been found that for a well-mixed feed stock, the behavior of the plastic material is very homogeneous, approximating the behavior of an average material.

Critical to the operation of the system (particularly when processing plastic materials) is that the rate of feed and temperature within process chamber 12 be carefully controlled. If the temperature of liquification portion of process chamber 12 is too low, or the rate of feed is too high the plastics will not be completely melted before reaching length L3 and the solid polymer materials will cross-link, forming a very tough product that will not gassify, and may not move through the process chamber at all, jamming system 10, or producing excessive waste at the char output. If the temperature of the liquification portion of process chamber is too high, the material will cross-link rather than melt. Generally, the requirements for processing contaminated soil are more relaxed, but the rate must be slow enough for heavier hydrocarbons to liquify while fast enough to avoid cracking of the gases. However, when processing contaminated soils or other materials where the goal is to eliminate the hydrocarbon content rather than to produce a useable fuel, cracking of the gases may not be a consideration and therefore the processing temperature may be raised or the rate of processing lowered without losing the benefit of the processing operation.

If the temperature of process chamber 12 within heating unit 27 is too low, or the rate of feed too high, little or no off gassing will occur, producing excessive waste (or too much residual contamination in soil processing) at the char output and a low yield at the gas output. The plastics reverted by system 10 generally begin to off-gas at a temperature higher than 400 degrees Fahrenheit, so the operating temperature of heating unit 27 (850° F.) ensures that the process temperature will be high enough to revert the plastics, but low enough to avoid cracking of the gases that have been extracted. In general, the rate of feed and temperature may be selected based on the materials being processed, average characteristics and other criteria to maximize throughput, conversion efficiency or both.

Figure 4B:
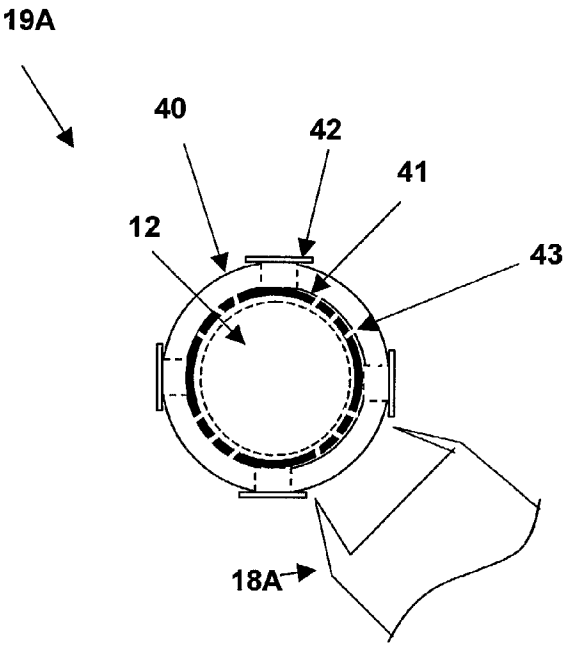
FIG. 4B is a pictorial diagram depicting a detailed end view of pressure chamber 19 of FIG. 2.
Figure 4A:
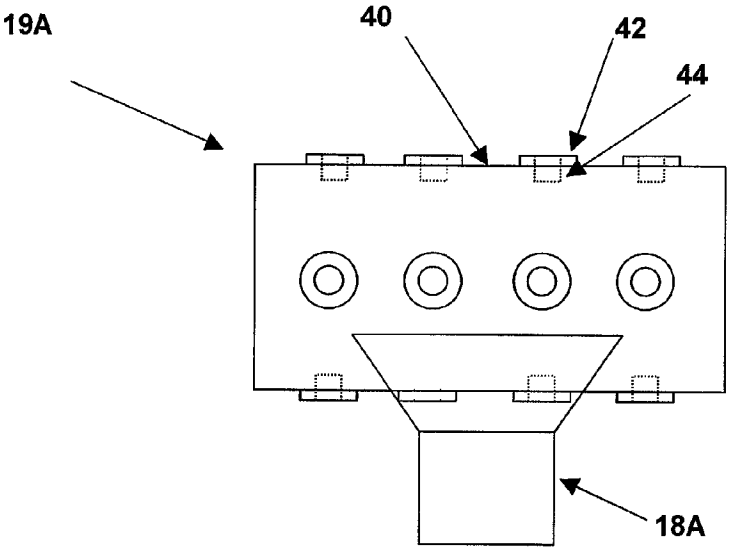
FIG. 4A is a pictorial diagram depicting a detailed side view of pressure chamber 19 of FIG. 2.
Figure 5:
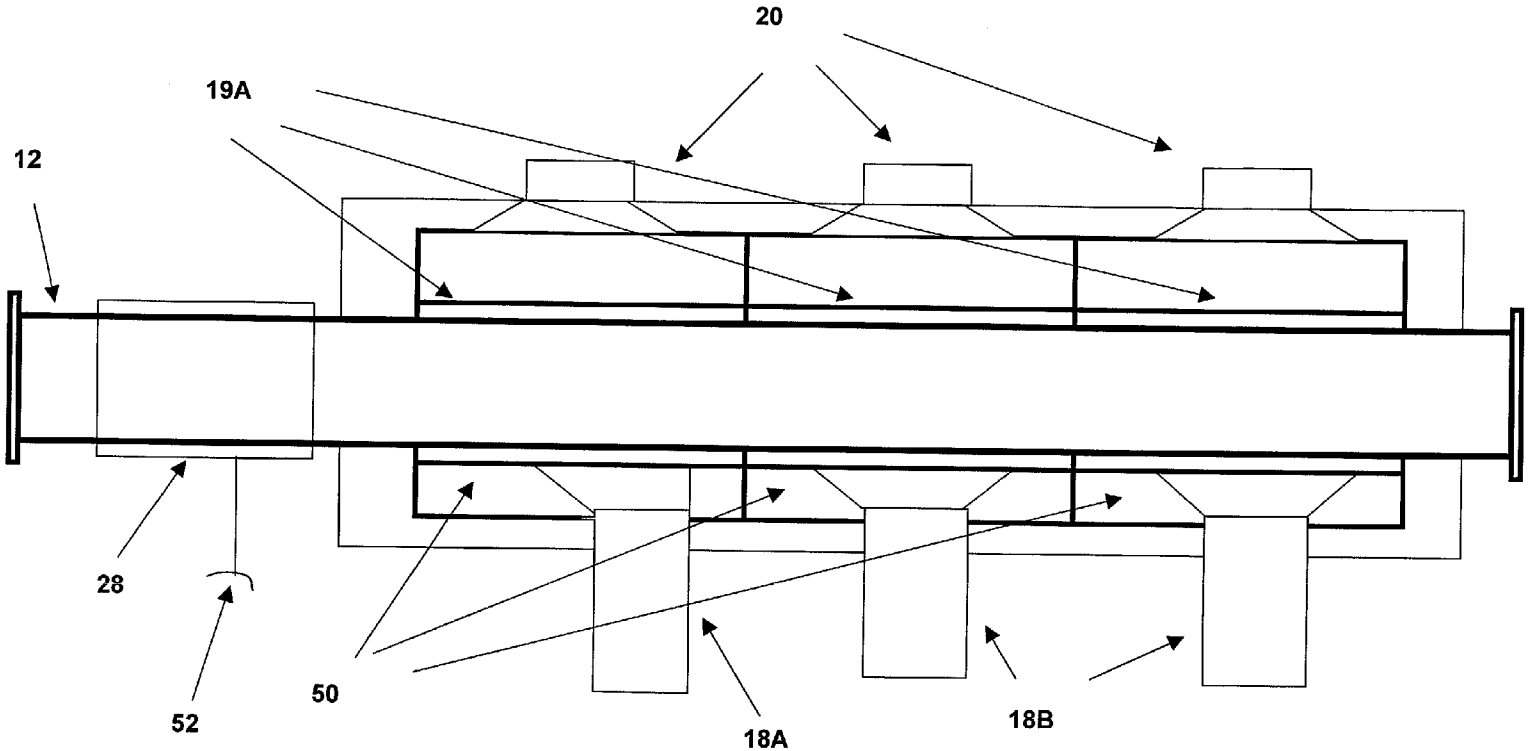
FIG. 5 is a pictorial diagram depicting details of the auger unit 27 of FIG. 2.

Referring now to FIGS. 4A and 4B, details of pressure chamber section 19A within pressure chamber 19 of FIG. 1 are depicted. FIG. 3A is a side view of a pressure chamber section 19A (there are three such sections making up pressure chamber 19 of FIG. 1). Pressure chamber section 19A comprises an inner pipe 41 and an outer pipe 40. The cylindrical wall of inner pipe 41 is perforated (to avoid the formation of "hot spots") and is connected to outer pipe 40 by a plurality of pipes that protrude through to the outer wall of outer pipe 40, supporting inner pipe 41 along with process chamber 12 (FIG. 1). A port 18A is directed at pressure chamber 19 to supply heated air around pressure chamber 19 to heat process chamber 12. FIG. 4B depicts a side view of pressure chamber 19, showing the orientation of pipes 42 and port 18A, as well as the location of perforations Referring now to FIG. 5, details of heating systems within the system of FIG. 2 are shown. Heat sheath 28 is an electric heater coupled to a power system 52, but may be replaced with a air circulated gas system as used in heating unit 27.

Heating unit 27 contains ports 18A and 18B that supply heated air to chambers 50, heating pressure chamber sections 19A and thus process chamber 12. Ports 20 return air to the heating system forming a closed loop through chambers 50.

Figure 6:
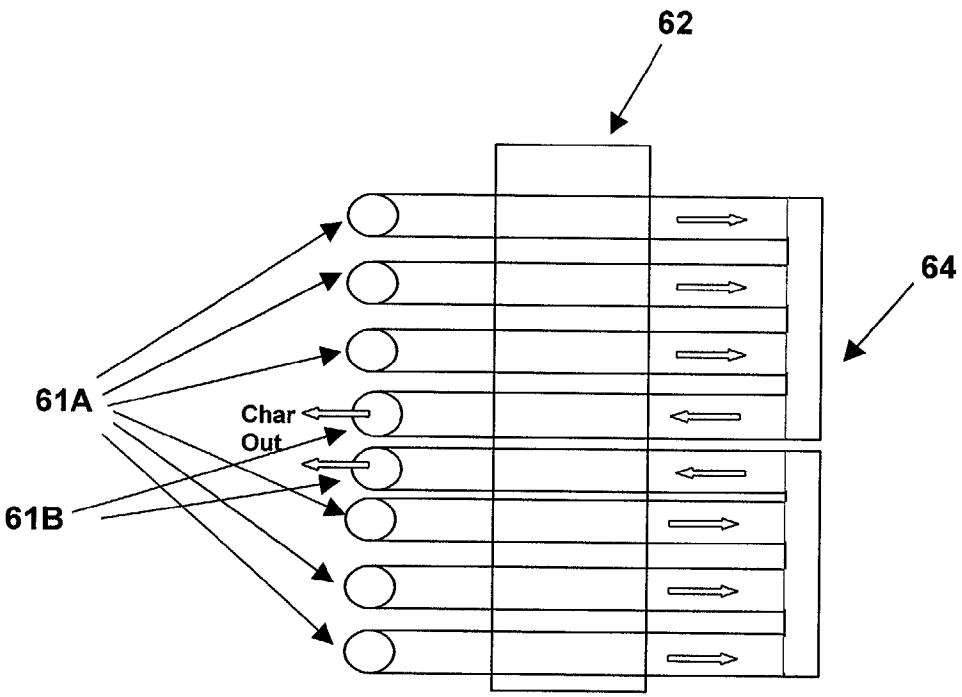
FIG. 6 is a pictorial diagram depicting a system in accordance with an alternative embodiment of the invention.

Referring now to FIG. 6 a system in accordance with an alternative embodiment of the invention is shown. In the alternative embodiment depicted, six process chambers 61A are placed in parallel and all pass through a common heating unit 62, providing more efficient use of the heating system. The char outputs of three each of the process chambers 61A are combined in piping manifolds 64 and are introduced to secondary process chambers 61B, that extracts any remaining gaseous fuel products. The char output of process chambers 61B is removed for discard or use. While the illustration shows a flattened parallel construction, in practice, the system may be formed with process chambers 61A arranged so that their cross sections form a ring, or they may be closely packed to improve coupling to heater 62 and reduce the exterior size of heater 62.

While the invention has been particularly shown and described with reference to the preferred embodiments thereof, it will be understood by those skilled in the art that the foregoing and other changes in form, and details may be made therein without departing from the spirit and scope of the invention.

What is claimed is:

1. A system for extracting usable hydrocarbon fuel pre-products from plastic material, comprising:

a process chamber for receiving said plastic material, said plastic material having been heated until said fuel pre-products are in a liquid form;

a heater for heating said process chamber to a substantially constant temperature, whereby said fuel pre-products are converted to gaseous hydrocarbon fuel products; and a vacuum system in continuous communication with said process chamber such that said process chamber is maintained at a negative relative pressure whereby said gaseous hydrocarbon fuel products are extracted from said liquid fuel pre-products by reducing a vapor pressure of said fuel products, thereby promoting off-gassing from said liquid fuel pre-products, wherein said process chamber has a continuous feed, said plastic material is received at a first end, said gaseous hydrocarbon fuel components are removed through said vacuum system and a remainder of said plastic material is ejected at a second end, and said process chamber further comprises an auger for feeding said plastic material through said process chamber; an auger housing for enclosing said auger; and a drive system coupled to said auger for rotating said auger to feed said plastic material through said process chamber and a portion of said auger is included in a melting chamber for heating said fuel pre-products to produce said liquid fuel pre-products prior to introduction to said process chamber, said melting chamber auger portion being heated to a lower temperature than a temperature of the process chamber auger portion.

2. The system of claim 1, further comprising an agitator for agitating said liquid fuel pre-products, whereby said off-gassing is further promoted.

3. The system of claim 1, further comprising a melting chamber for heating said fuel pre-products to produce said liquid fuel pre-products prior to introduction to said process chamber.

4. The system of claim 3, wherein said melting chamber is heated to a temperature substantially equal to 585 degrees Fahrenheit.

5. The system of claim 3, wherein said melting chamber is heated to a temperature of at least 585 degrees Fahrenheit.

6. The system of claim 1, wherein said process chamber is heated to a temperature substantially equal to 850 degrees Fahrenheit.

7. The system of claim 1, wherein said process chamber is heated to a temperature within the range of 850 to 890 degrees Fahrenheit.

8. The system of claim 1, wherein said vacuum system generates a vacuum within said process chamber substantially equal to minus 0.07 psig.

9. The system of claim 1, wherein said vacuum system generates a vacuum within said process chamber of at least minus 0.07 psig.

10. The system of claim 1, wherein said auger further comprises agitator buckets attached to a blade of said auger for agitating said liquid fuel pre-products, whereby said off-gassing is further promoted.

11. The system of claim 1, wherein a blade of said auger is coated with a non-stick coating, whereby accumulation of liquid plastic material on said blade is prevented.

12. The system of claim 1, further comprising a feed system for feeding said plastic material into said melting chamber, said feed system comprising: a feed hopper coupled to said process chamber, whereby said plastic material is introduced to said system; and a feed auger for compressing said plastic material and introducing said compressed plastic material to said process chamber.

13. The system of claim 1, wherein said heater comprises a pressure chamber disposed around said process chamber, whereby hot air is circulated to heat said process chamber.

14. The system of claim 13, wherein said pressure chamber comprises a: first cylinder enclosing said process chamber, said first cylinder having perforations though a wall of said cylinder for diffusing heat from an inner wall to an outer wall of said first cylinder for providing a uniform temperature at said process chamber; and a second cylinder enclosing said first cylinder, said second cylinder including a plurality of pipes disposed radially between an outer wall of said second cylinder and an inner wall of said first cylinder , whereby heated air may pass from said outer wall of said second cylinder to said process chamber.

15. The system of claim 1, wherein said heater is a closed-system air heater, wherein said air is recirculated around said process chamber.

16. The system of claim 15, comprising multiple process chambers for performing said extraction in parallel, and wherein said multiple process chambers are coupled to said heater for heating said multiple process chambers.

17. The system of claim 16, wherein a remainder of said plastic material from each of said multiple process chambers is fed through an additional process chamber coupled to said heater for removing any remaining hydrocarbon fuel products from said remainder.

18. A system for extracting usable hydrocarbon fuel pre-products from plastic material, comprising:

means for liquefying said hydrocarbon fuel pre-products;

means for heating said hydrocarbon fuel pre-products to form gaseous hydrocarbon fuel products;

means for continuously removing said gaseous hydrocarbon fuel products so that said hydrocarbon fuel pre-products will continue to off-gas;

means for agitating said liquid hydrocarbon fuel products to promote said off-gassing; and means for removing a remainder of said plastic material from said liquid hydrocarbon fuel products, wherein said means for agitating and means for removing comprise an auger for feeding said plastic material through said means for heating; an auger housing for enclosing said auger; and a drive system coupled to said auger for rotating said auger to feed said plastic material through said means for heating and a portion of said auger is included in the means for liquefying for heating said fuel pre-products to produce said liquid fuel pre-products prior to introduction to said means for heating, said portion of said auger in the means for liquefying being heated to a lower temperature than a temperature of the means for heating auger portion.

19. A system for extracting usable hydrocarbon fuel pre-products from plastic material, comprising:

a melting chamber for receiving the plastic material and heating the fuel pre-products into a liquid form;

a process chamber for receiving the liquid fuel pre-products;

an auger extending from within the melting chamber into and through the process chamber for feeding the liquid fuel pre-products from the melting chamber into the process chamber;

a heater for further heating the liquid fuel pre-products in the process chamber to a temperature at which the fuel pre-products are converted to gaseous hydrocarbon fuel products; and a vacuum system in continuous communication with the process chamber such that the process chamber is maintained at a reduced relative pressure wherein the gaseous hydrocarbon fuel products are extracted from the liquid fuel pre-products when the reduced relative pressure in the process chamber promotes off-gassing of the gaseous hydrocarbon fuel products.

20. The system of claim 19 wherein the system subjects the gaseous hydrocarbon fuel products to temperatures at which cracking of the products is avoided.

21. The system of claim 19 further comprising an auger housing for enclosing the auger and a drive system coupled to the auger for rotating the auger.

22. The system of claim 19 wherein the auger further comprises agitator buckets attached to a blade of the auger.

23. The system of claim 1 wherein said system subjects the gaseous hydrocarbon fuel products to temperatures at which cracking of the products is avoided.

24. The system of claim 18 wherein said system subjects the gaseous hydrocarbon fuel products to temperatures at which cracking of the products is avoided.

25. The system of claim 18 further comprising a feed system for feeding said plastic material into said system.

26. The system of claim 18 wherein the auger further comprises agitator buckets attached to a blade of the auger.

27. A system for extracting usable hydrocarbon fuel pre-products from plastic material, comprising:

a process chamber for receiving said plastic material, said plastic material having been heated until said fuel pre-products are in a liquid form;

a heater for heating said process chamber to a substantially constant temperature, whereby said fuel pre-products are converted to gaseous hydrocarbon fuel products; and a vacuum system in continuous communication with said process chamber such that said process chamber is maintained at a negative relative pressure whereby said gaseous hydrocarbon fuel products are extracted from said liquid fuel pre-products by reducing a vapor pressure of said fuel products, thereby promoting off-gassing from said liquid fuel pre-products wherein said process chamber has a continuous feed, said plastic material is received at a first end, said gaseous hydrocarbon fuel components are removed through said vacuum system and a remainder of said plastic material is ejected at a second end, and said process chamber comprises an auger for feeding said plastic material through said process chamber; an auger housing for enclosing said auger; and a drive system coupled to said auger for rotating said auger to feed said plastic material through said process chamber, wherein a portion of said auger is included in a melting chamber for heating said fuel pre-products to produce said liquid fuel pre-products prior to introduction to said process chamber, said melting chamber auger portion being heated to a lower temperature than a temperature of the process chamber auger portion and a blade of said auger is coated with a non-stick coating, whereby accumulation of liquid plastic material on said blade is prevented, wherein said system subjects the gaseous hydrocarbon fuel products to temperatures at which cracking of the products is avoided.

28. A system for extracting usable hydrocarbon fuel pre-products from plastic material, comprising:

a process chamber for receiving said plastic material, said plastic material having been heated until said fuel pre-products are in a liquid form;

a heater for heating said process chamber to a substantially constant temperature, whereby said fuel pre-products are converted to gaseous hydrocarbon fuel products; and a vacuum system in continuous communication with said process chamber such that said process chamber is maintained at a negative relative pressure whereby said gaseous hydrocarbon fuel products are extracted from said liquid fuel pre-products by reducing a vapor pressure of said fuel products, thereby promoting off-gassing from said liquid fuel pre-products; and a feed system for feeding said plastic material into said melting chamber, said feed system comprising: a feed hopper coupled to said process chamber, whereby said plastic material is introduced to said system; and a feed auger for compressing said plastic material and introducing said compressed plastic material to said process chamber, wherein said process chamber has a continuous feed, said plastic material is received at a first end, said gaseous hydrocarbon fuel components are removed through said vacuum system and a remainder of said plastic material is ejected at a second end, and said process chamber comprises an auger for feeding said plastic material through said process chamber; an auger housing for enclosing said auger; and a drive system coupled to said auger for rotating said auger to feed said plastic material through said process chamber, wherein a portion of said auger is included in a melting chamber for heating said fuel pre-products to produce said liquid fuel pre-products prior to introduction to said process chamber, said melting chamber auger portion being heated to a lower temperature than a temperature of the process chamber auger portion.

wherein said system subjects the gaseous hydrocarbon fuel products to temperatures at which cracking of the products is avoided.

* * * * *